US009888822B2

(12) United States Patent
Shin

(10) Patent No.: US 9,888,822 B2
(45) Date of Patent: Feb. 13, 2018

(54) MOP TOOL

(71) Applicant: Manchul Shin, New York, NY (US)

(72) Inventor: Manchul Shin, New York, NY (US)

(73) Assignee: Manchul Shin, New York, NY (US)

( * ) Notice: Subject to any disclaimer, the term of this patent is extended or adjusted under 35 U.S.C. 154(b) by 0 days.

(21) Appl. No.: 15/194,093

(22) Filed: Jun. 27, 2016

(65) Prior Publication Data

US 2017/0014014 A1 Jan. 19, 2017

(30) Foreign Application Priority Data

Jul. 14, 2015 (KR) ..... 10-2015-0099990

(51) Int. Cl.

| | |
|---|---|
| ***A47L 13/254*** | (2006.01) |
| ***B25G 3/38*** | (2006.01) |
| ***A47L 13/255*** | (2006.01) |
| ***A47L 13/24*** | (2006.01) |
| ***A47L 13/256*** | (2006.01) |
| ***A47L 13/44*** | (2006.01) |

(52) U.S. Cl.

CPC ..... *A47L 13/254* (2013.01); *A47L 13/24* (2013.01); *A47L 13/255* (2013.01); *A47L 13/256* (2013.01); *A47L 13/44* (2013.01); *B25G 3/38* (2013.01)

(58) Field of Classification Search

CPC ..... A47L 13/20; A47L 13/24; A47L 13/254; A47L 13/255; A47L 13/256; A47L 13/258; A47L 13/42; A47L 13/44; A47L 13/46

USPC ..... 15/147.1, 147.2, 228, 229.1–229.9, 144, 15/1, 144.2

See application file for complete search history.

(56) References Cited

U.S. PATENT DOCUMENTS

| | | | | |
|---|---|---|---|---|
| 1,535,540 | A * | 4/1925 | Moore | A47L 13/24 15/147.2 |
| 1,762,454 | A * | 6/1930 | Poulos | A47L 13/24 15/150 |
| 4,766,632 | A * | 8/1988 | Murray | A47L 13/258 15/144.1 |
| 6,546,584 | B2 | 4/2003 | Hobden | |
| 7,191,486 | B1 * | 3/2007 | Michelson | A47L 13/20 15/147.2 |
| 2003/0009839 | A1 * | 1/2003 | Streutker | A47L 13/24 15/228 |

(Continued)

FOREIGN PATENT DOCUMENTS

| | | | |
|---|---|---|---|
| DE | 19650868 | * | 6/1998 |
| EP | 599227 | * | 6/1994 |

(Continued)

OTHER PUBLICATIONS

English translation of First Korean Office Action, issued in Korean Patent Application No. 10-2015-0099990.

(Continued)

*Primary Examiner* — Mark Spisich

(74) *Attorney, Agent, or Firm* — McDermott Will & Emery LLP

(57) ABSTRACT

Disclosed is a mop tool. The mop tool includes an elongated stick; and a plate-shaped cleaning head rotatably coupled to one end of the stick and having two or more mop fasteners that have different coupling types. The cleaning head is provided with a mop hanging bar from which a connecting loop of a mop hangs.

15 Claims, 11 Drawing Sheets

(56) References Cited

U.S. PATENT DOCUMENTS

| | | | | |
|---|---|---|---|---|
| 2004/0128786 | A1* | 7/2004 | Policicchio | A47L 13/20 15/228 |
| 2005/0102781 | A1 | 5/2005 | Tsuchiya et al. | |
| 2011/0023251 | A1* | 2/2011 | Bober | A47L 13/256 15/228 |
| 2013/0133148 | A1* | 5/2013 | Wu | A47L 13/256 15/147.2 |
| 2015/0128371 | A1* | 5/2015 | Zorzo | A47L 13/254 15/228 |

FOREIGN PATENT DOCUMENTS

| | | | |
|---|---|---|---|
| EP | 1238621 | * | 9/2002 |
| FR | 1247167 | * | 11/1960 |
| GB | 987730 | * | 3/1965 |
| GB | 2411578 | * | 9/2005 |
| JP | 9-56654 | * | 3/1997 |
| JP | 9-84730 | * | 3/1997 |
| JP | 9-173265 | * | 7/1997 |
| JP | 10-179486 | * | 7/1998 |
| JP | 11-47058 | * | 2/1999 |
| JP | 2001-37698 | * | 2/2001 |
| JP | 2004-049619 | A | 2/2004 |
| JP | 2005-287698 | A | 10/2005 |
| JP | 4395715 | B2 | 1/2010 |
| JP | 4676755 | B2 | 4/2011 |
| JP | 3173533 | U | 2/2012 |
| KR | 20-2003-0025613 | Y1 | 12/2003 |
| KR | 10-2003-0054622 | B1 | 7/2004 |
| KR | 10-1455037 | B1 | 10/2014 |
| KR | 10-2016-0017965 | A | 2/2016 |
| WO | 2005/074781 | * | 8/2005 |
| WO | 2011/097176 | * | 8/2011 |

OTHER PUBLICATIONS

Decision to Grant, Korean Patent Application No. 10-2015-009990 dated Oct. 27, 2016 with full English translation.

U.S. Non-final Office Action dated Jun. 30, 2017 issued in U.S. Appl. No. 15/408,891.

* cited by examiner

MOP TOOL

This application is based on and claims priority from Korean Patent Application No. 2015-0099990, filed on Jul. 14, 2015, with the Korean Intellectual Property Office, the disclosure of which is incorporated herein in its entirety by reference.

TECHNICAL FIELD

The present disclosure relates to a mop tool coupled with a mop for cleaning.

BACKGROUND

In general, a mop tool is used to clean a floor. The mop tool is used in a state in which a mop is fixed to a head portion provided at one end of the mop tool. There are some mop tools coupled with reusable mops which can be reused by washing the mops. Also, there are other mop tools coupled with disposable mops which can be replaced after use.

Different types of mop tools are selected and used in accordance with the type of the mop to be used. For example, there is a mop tool coupled with a reusable mop such as a tube mop or a string mop and there is another mop tool coupled with a disposable mop made of non-woven fabrics, superfine fibers or microfibers. See, for example, Korean Patent Publication Nos. 10-0439952 and 10-1455037.

SUMMARY

According to an embodiment of the present disclosure, there is provided a mop tool. The mop tool includes an elongated stick; and a plate-shaped cleaning head rotatably coupled to one end of the stick and having two or more mop fasteners that have different coupling types. The cleaning head is provided with a mop hanging bar from which a connecting loop of a mop hangs.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
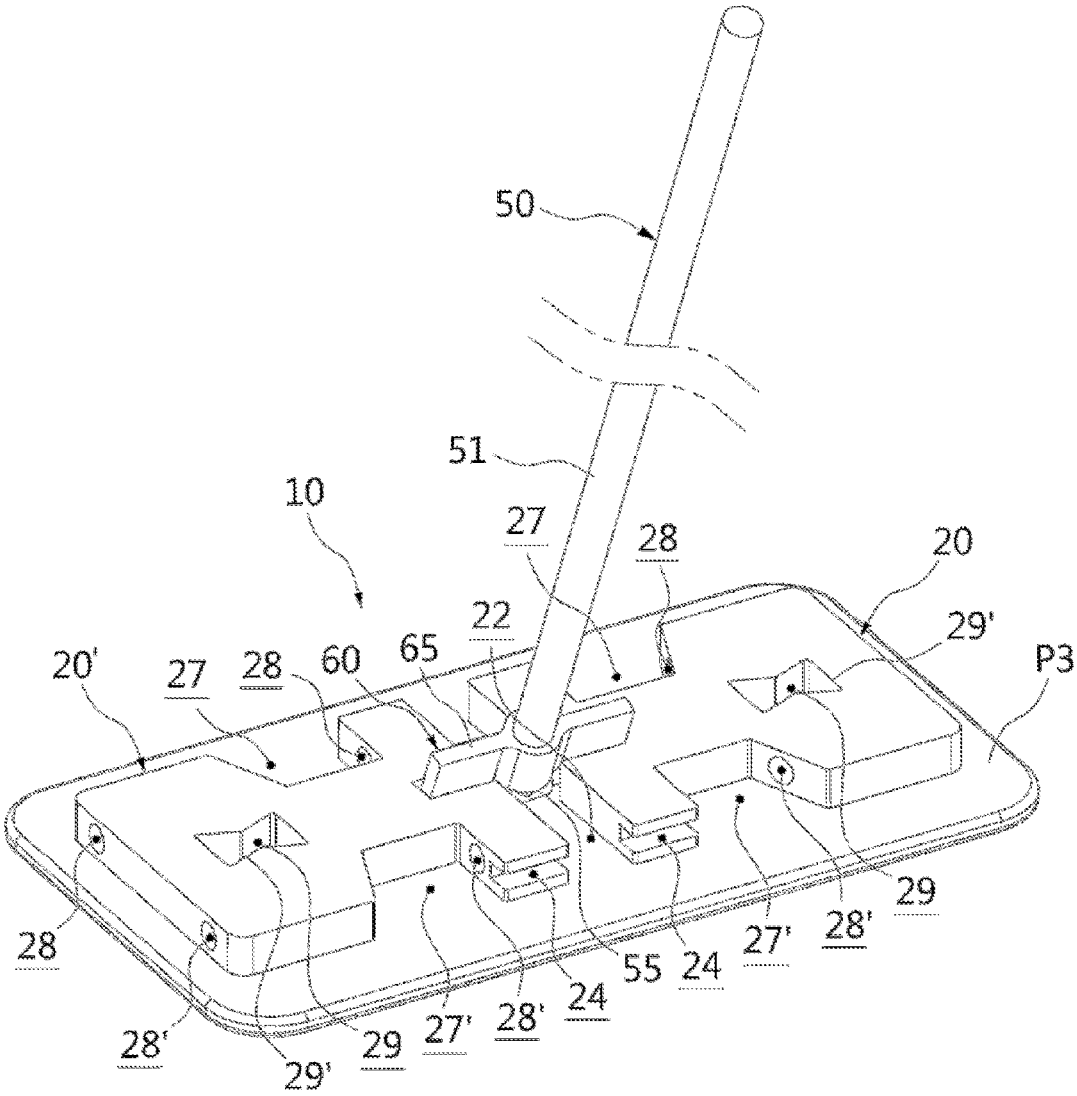
FIG. 1 is a perspective view illustrating a state in which a mop is coupled to a mop tool according to an embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

In general, various types of mops require different mop tools matched therewith. It is necessary to obtain the corresponding mop tool in order to use a desired type of mop and this is inconvenient for a user.

For example, because a reusable mop, which is reusable after being washed, and a disposable mop are completely different from each other in terms of a coupling structure thereof, these mops are difficult to be used with a single mop tool. In addition, in a case in which mops have different lengths even though the mops are of the same type, the mops cannot be used with the same mop tool, and as a result, there is an inconvenience of obtaining various mop tools that meet respective standards of the mops.

The present disclosure has been made in consideration of these problems, and the present disclosure provides a mop tool for allowing to use various types and sizes of mops.

According to an embodiment of the present disclosure, there is provided a mop tool. The mop tool includes an elongated stick; and a plate-shaped cleaning head rotatably coupled to one end of the stick and having two or more mop fasteners that have different coupling types. The cleaning head is provided with a mop hanging bar from which a connecting loop of a mop hangs.

At least one of the mop fasteners may include a mop fixing hole or a Velcro tape. A part of the mop can be fitted into the mop fixing hole and the mop can be coupled to the Velcro tape in a Velcro manner. The mop fixing hole may be provided with a fixing protrusion protruding in a direction of narrowing an inlet of the mop fixing hole.

The cleaning head may have at least one groove inwardly dented therein and the mop hanging bar traverses the groove.

The cleaning head may have a gap extending from a portion where the cleaning head is coupled to the one end of the stick to at least one side of the cleaning head. The stick rotates to pass through the gap. The one end of the stick may be hingedly coupled to a central portion of the cleaning head.

The cleaning head may include a first head body; a second head body symmetrical with respect to the first head body; and a connecting post connecting the first head body with the second head body. The one end of the stick is coupled to the connecting post. The one end of the stick may be hingedly coupled to the connecting post. A reinforcing post may be provided to traverse the first head body and the second head body.

The cleaning head may further include at least one extension block provided at either or both of two opposite sides of the cleaning head so as to be movable away from the cleaning head. The extension block may include a block body; and at least one extending post having one end coupled to the block body and another end extending into the cleaning head. The block body may be provided with a pair of extending posts spaced from each other, and the extending posts traverse grooves inwardly dented in the cleaning head to form the mop hanging bar.

A first elastic member may be provided in the cleaning head so as to provide elastic force to the block body of the extension block in a direction away from the cleaning head, and the extending post and the cleaning head have fastening structures corresponding to each other in order to allow an adjustment of a protrusion amount of the extension block from the cleaning head. The fastening structures may include a fastening protrusion provided on the extending post; and fastening grooves in the cleaning head. The fastening protrusion is selectively inserted into the fastening grooves. The fastening grooves are formed to be spaced apart from each other in a direction in which the extending post moves. An operation button may be provided on an outer surface of the cleaning head. The operation button exerts external force on the fastening protrusion so that the fastening protrusion of the extending post is withdrawn from the fastening groove.

The mop tool may further include a locker movable along the stick and selectively coupled to a side of the cleaning head in order to restrict a relative rotation between the cleaning head and the stick. A first locking groove may be formed at a lateral side of the cleaning which is positioned on a rotation route of the stick, and the locker can be inserted to the first locking groove. The cleaning head may have a gap extending from a portion where the cleaning head is coupled to the one end of the stick toward the lateral side of the cleaning head at which the first locking groove is formed, and the stick rotates to pass through the gap. A second locking groove may be formed at a central portion of the cleaning head and the locker can be inserted to the second locking groove. When the locker is inserted into the second locking groove, the stick forms a predetermined angle with respect to the cleaning head. The locker may include a locking body having a coupling hole into which the stick is inserted; and locking pieces extending from two opposite sides of the locking body to be inserted into at least one of the first and second locking grooves.

Hereinafter, embodiments of the present disclosure will be described with reference to drawings.

FIG. 1 illustrates a mop tool according to one embodiment of the present disclosure. As illustrated, the mop tool includes a stick 50, and a cleaning head 10 rotatably coupled to the stick 50.

A body 51 of the stick 50 is a portion which is shaped to be elongated in one direction, and is held and used by a user. The stick 50 may be formed not to extend only in one direction and may have a bent or round shape. The stick 50 also may have a circular cross section or a polygonal cross section.

The cleaning head 10 is coupled to the stick 50. The cleaning head 10 is connected to one end of the stick 50 and coupled to a mop. As illustrated, the cleaning head 10 is formed in a generally planar shape. The cleaning head 10 is formed in a rectangular plate shape in the present embodiment, but the shape of the cleaning head 10 may be variously modified. For example, the cleaning head 10 may have a circular, elliptical, circular arc, semi-circular, or trapezoidal shape. A bottom surface of the cleaning head 10 may be provided with a friction member for improving frictional force between the cleaning head 10 and the mop disposed therebelow. The friction member may include an embossing structure having a plurality of projections, and may be made of a rubber material.

The cleaning head 10 includes a first head body 20 and a second head body 20' which are symmetrical with respect to each other. The first head body 20 and the second head body 20' are provided to be symmetrical with respect to each other at both sides at one end of the stick 50. The first head body 20 and the second head body 20' may be assembled and used as separate components, or integrally formed.

A reinforcing post 21 is provided between the first head body 20 and the second head body 20'. The reinforcing post 21 is coupled between the first head body 20 and the second head body 20'. The reinforcing post 21 can prevent a relative rotation between the head bodies 20 and 20'. The reinforcing post 21 may be formed as an elongated rod as illustrated in FIG. 1, or may be formed in a form of a plate like the first head body 20 or the second head body 20'.

A gap 22 is formed between the first head body 20 and the second head body 20'. The gap 22 is a space formed between the first head body 20 and the second head body 20' and a width of the gap 22 is equal to or greater than a width of the stick 50 so that the stick 50 can rotate and pass through the gap 22.

A connecting post 30 is provided at a central portion of the cleaning head 10. The connecting post 30 is configured in a form of a bar that connects the first head body 20 to the second head body 20'. The connecting post 30 has a cylindrical shape in the embodiment illustrated in FIG. 1. The connecting post 30 serves to connect the first head body 20 with the second head body 20', and is hingedly coupled to the stick 50 so as to allow the stick 50 and the cleaning head 10 to rotate relative to each other. In the present embodiment, a portion of the cleaning head 10 around the periphery of the connecting post 30 is formed to be opened, but the shape of the portion is not necessarily limited thereto, and the connecting post 30 may be configured to be closed by a portion of the cleaning head.

A hinge unit 55 of the stick 50 is coupled to the connecting post 30. The hinge unit 55 is coupled to surround the connecting post 30, and rotatably coupled to the connecting post 30. With the hinge unit 55, the stick 50 and the cleaning head 10 can rotate relative to each other.

The cleaning head 10 is provided with two or more mop fasteners which have different coupling types. The mop fasteners may be provided on one or more of the upper and bottom surfaces of the cleaning head 10. At least one of the mop fasteners may include a Velcro tape, an adhesive attachment structure, a hook-and-loop type coupling structure, or an insertion hole.

In FIG. 1, mop fixing holes 29 are formed as the mop fasteners in the cleaning head 10. The mop fixing hole 29 is formed to partially or entirely penetrate the cleaning head 10 in a thickness direction of the cleaning head, and a part of the mop is inserted and fixed into the mop fixing hole 29. For example, a part of the mop, which surrounds the cleaning head 10, is inserted into the mop fixing hole 29, such that the mop can be maintained in a state of being coupled to the cleaning head 10. Therefore, a typical mop or towel, which does not have a fixing structure such as a Velcro tape, can be fixed to the cleaning head 10 by means of the mop fixing hole 29.

Figure 2:
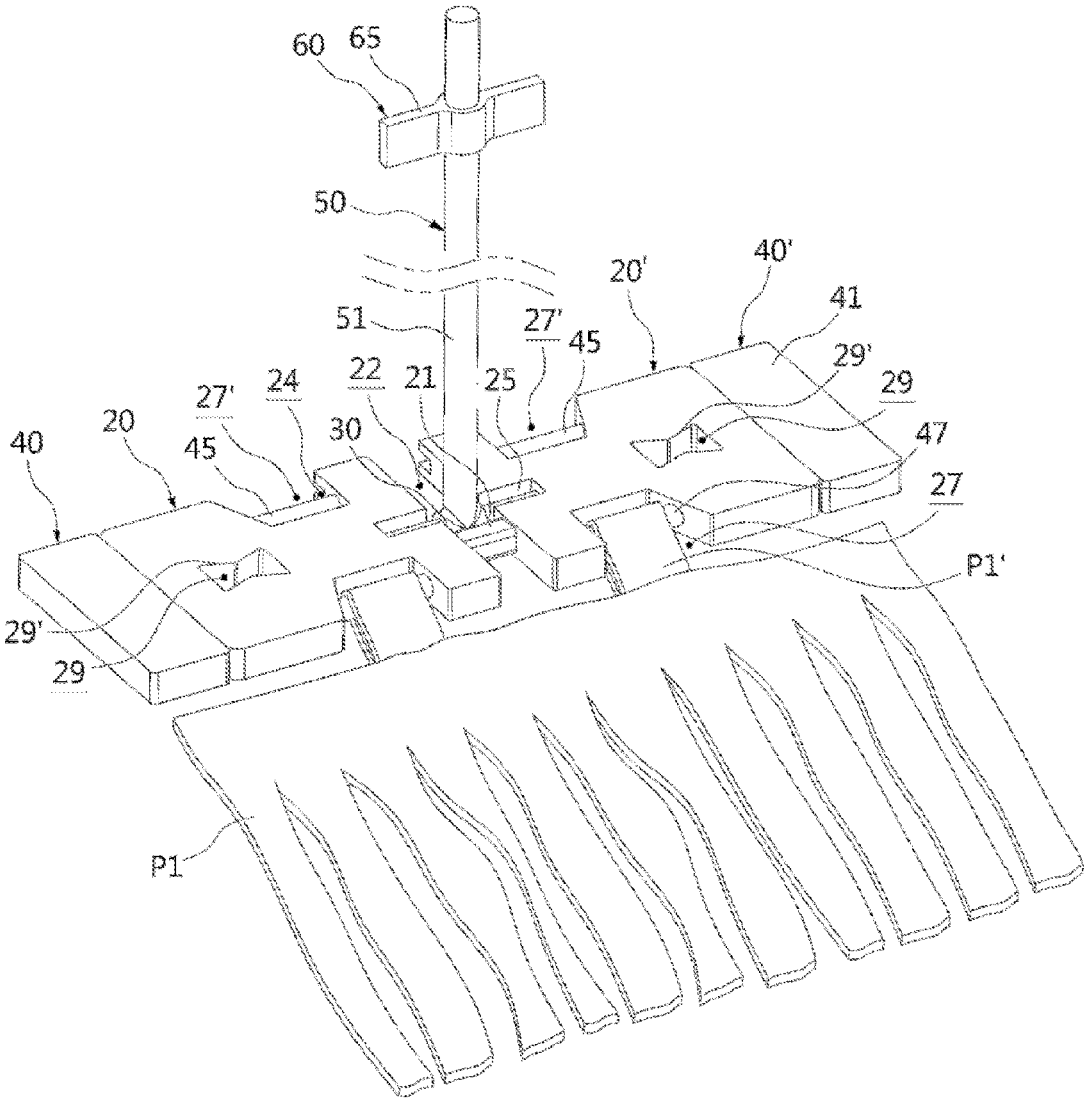
FIG. 2 is a perspective view illustrating a state in which a stick of the mop tool illustrated in FIG. 1 stands from a cleaning head of the mop tool.
Figure 3:
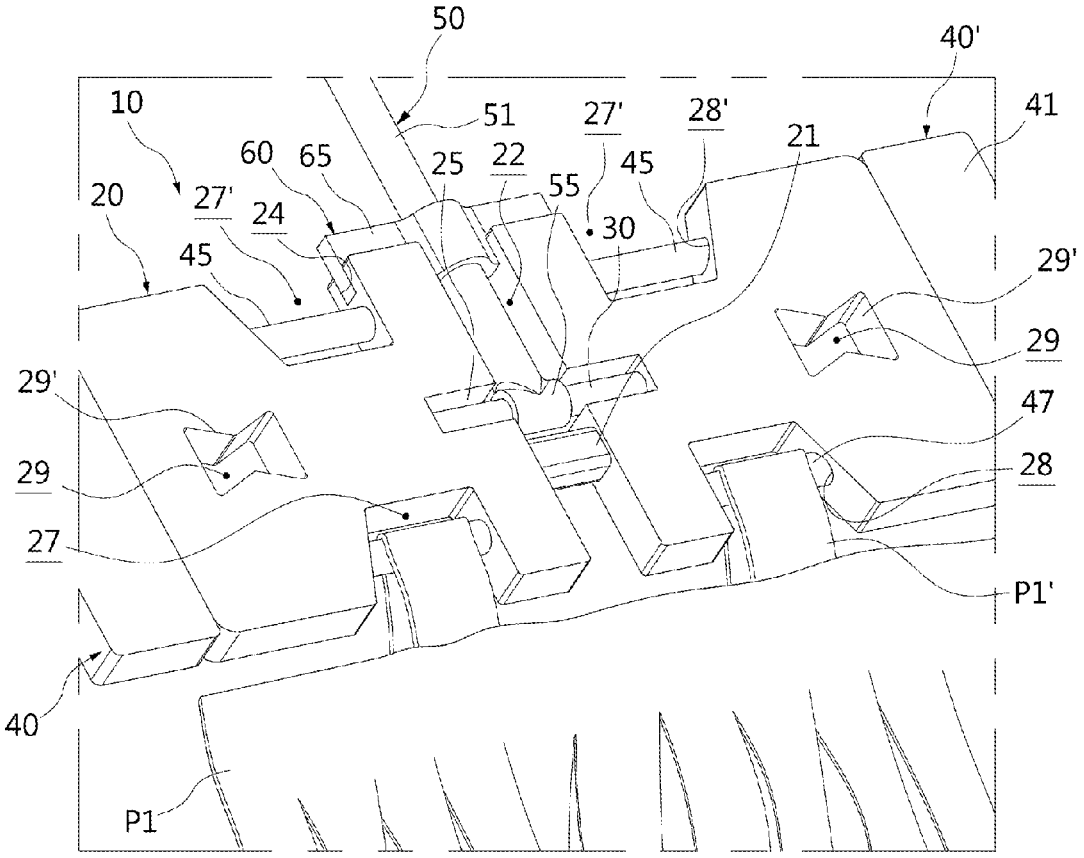
FIG. 3 is an enlarged perspective view of the cleaning head of the mop tool illustrated in FIG. 1.

In FIGS. 1 to 3, the mop fixing holes 29 are formed in the first head body 20 and the second head body 20'. Fixing protrusions 29' protrude in the mop fixing hole 29 in a direction of narrowing an inlet of the mop fixing hole 29. With the fixing protrusions 29', the mop can be kept securely fixed in the mop fixing hole 29. In the present embodiment, a pair of fixing protrusions 29' protrude in one mop fixing hole 29 opposite to each other, but a single fixing protrusion 29' may be provided in one mop fixing hole 29, or three or more fixing protrusions 29' may be provided in one mop fixing hole 29. Of course, three or more mop fixing holes 29 may be formed in the cleaning head 10.

Figure 4:
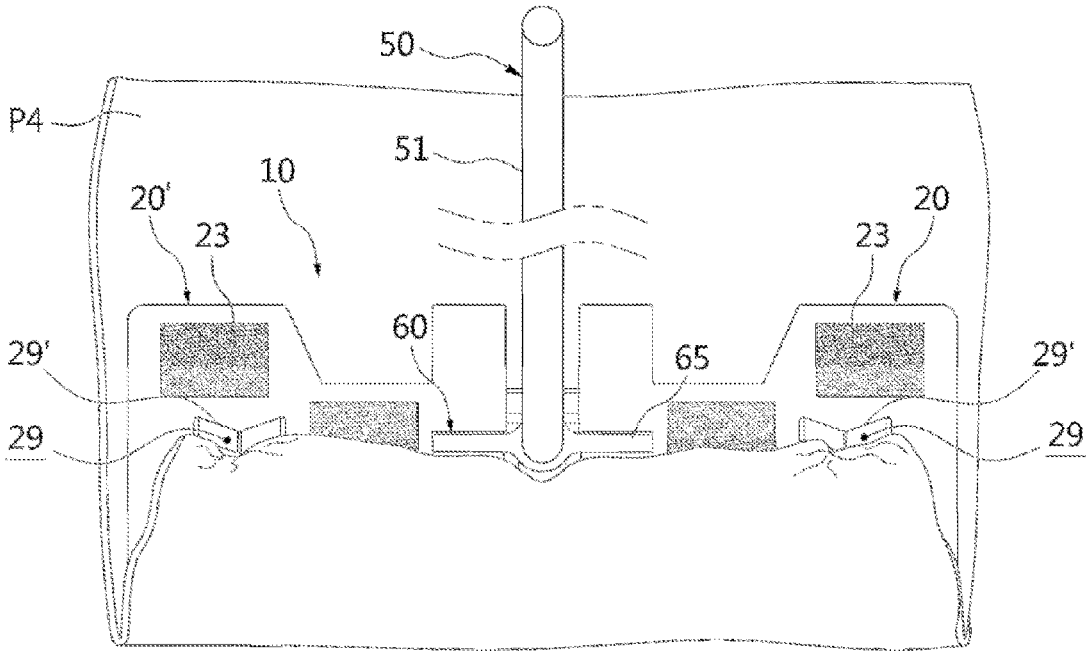
FIGS. 4 and 5 show sequential states in which a mop is being coupled to a mop tool according to another embodiment of the present disclosure.
Figure 5:
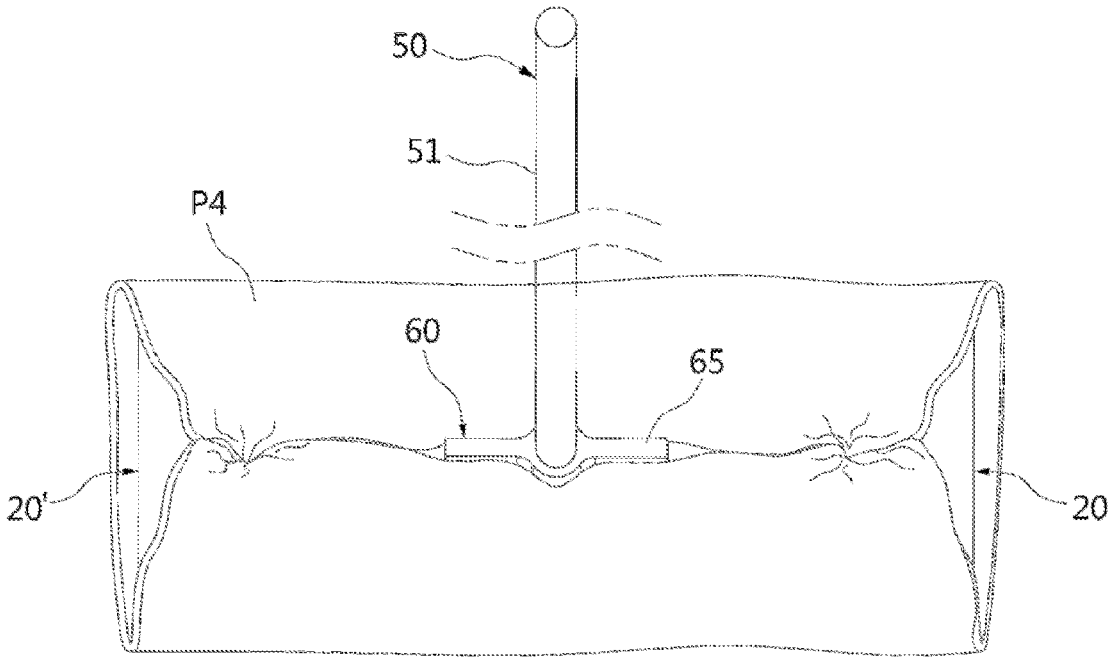

FIGS. 4 and 5 illustrate a state in which a commonly used mop P4 or towel is fixed to the mop fixing holes 29 of the mop tool illustrated in FIG. 1. As illustrated, in a case in which the common mop P4 is used, the cleaning head 10 is placed on the mop, one side of the mop is wound up to surround the cleaning head 10, and then a part of the mop is inserted into the mop fixing hole 29. The state described above is illustrated in FIG. 4.

Subsequently, the remaining side of the mop is wound up to surround the opposite side of the cleaning head 10, and then a part of the mop is also inserted into the mop fixing hole 29, such that the mop P4 can be securely fixed to the cleaning head 10. The state described above is illustrated in FIG. 5.

In FIG. 4, Velcro tapes 23 are formed as the mop fasteners on the upper surface of the cleaning head 10. A mop has corresponding Velcro tapes that can be attached to the Velcro tapes 23 of the cleaning head 10. For example, the Velcro tape of the mop and the Velcro tape 23 of the cleaning head 10 are coupled to each other in a state in which the mop surrounds the cleaning head 10 as illustrated in FIGS. 4 and 5. Unlike the embodiment illustrated in FIG. 1, the Velcro tape 23 of the cleaning head 10 may be provided on a bottom or lateral surface of the cleaning head 10.

At least one groove 27 or 27' is formed to be dented inwardly in the cleaning head 10. The groove is a portion where at least one mop hanging bar 45 or 47 is provided, which will be described below, and the mop hanging bar is installed to traverse the groove. In the present embodiment, a total of four grooves 27 and 27' are formed, and for convenience of description, a lower groove is referred to as a first groove 27, and an upper groove is referred to as a second groove 27' based on FIG. 1.

The mop hanging bars 45 and 47 are provided in the grooves 27 and 27'. The mop hanging bars 45 and 47 are provided to traverse the grooves 27 and 27', and more specifically, the mop hanging bars 45 and 47 extend in a direction in which the first head body 20 and the second head body 20' are coupled. The mop hanging bars 45 and 47 are configured in a form of a bar, and connecting loops P1' of the mop P1 depend from the mop hanging bars 45 and 47. FIGS. 1 to 3 illustrate states in which the connecting loops P1' of the mop P1 hang from the mop hanging bars. The mop P1 may be a rag which is to be wet with water.

The mop hanging bars 45 and 47 may be provided at upper and lower sides of the cleaning head 10, respectively, as illustrated in FIG. 1, or may be provide at only one of the upper and lower sides of the cleaning head 10. In a case in which the mop hanging bars 45 and 47 are provided at both of the upper and lower sides of the cleaning head 10, the two mops P1 may be coupled to the mop hanging bars, respectively, and then used. The mop hanging bars 45 and 47 may form extending posts 45 and 47, which will be described below.

Figure 6:
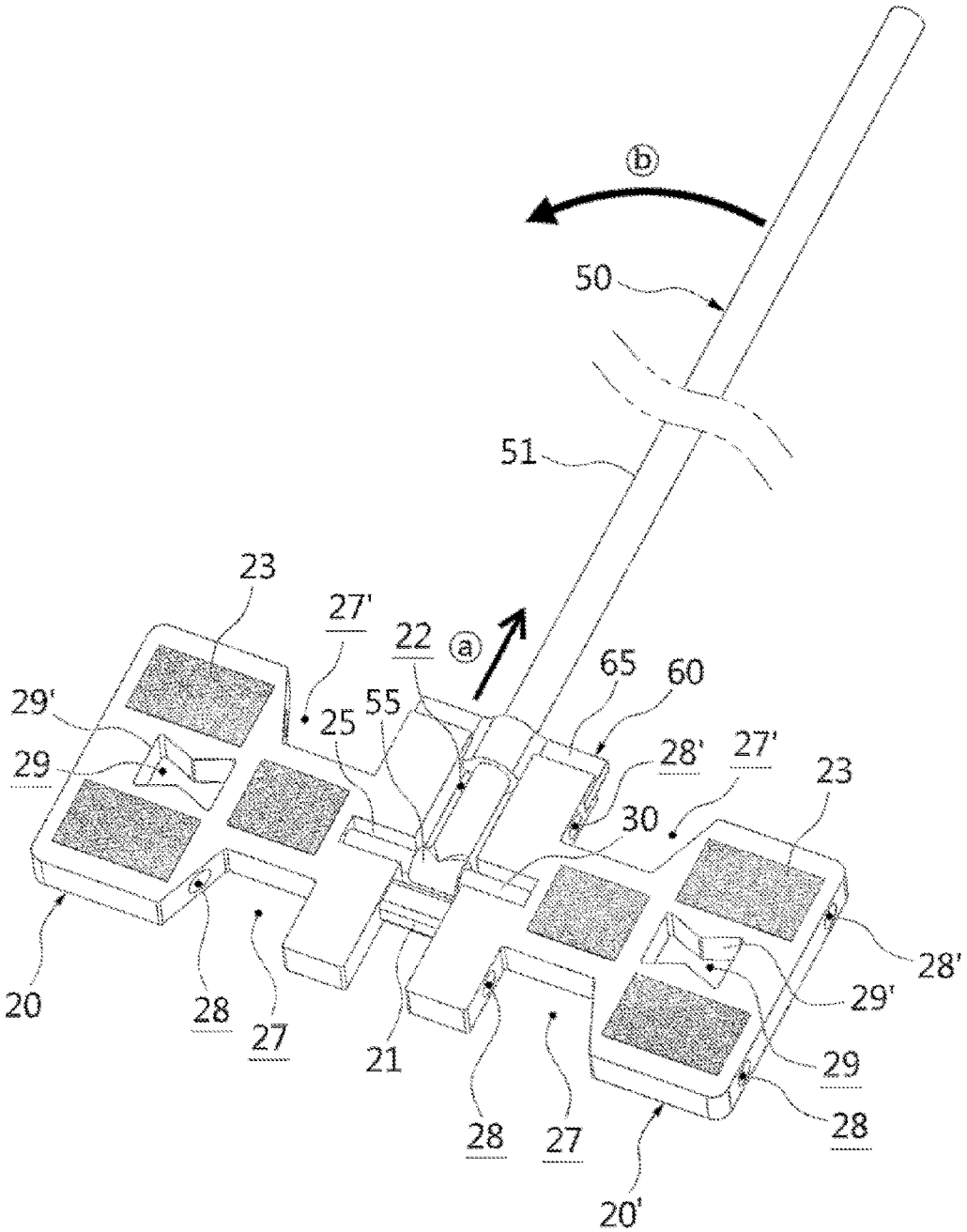
FIG. 6 is a perspective view illustrating a bottom surface of a cleaning head included in the mop tool illustrated in FIGS. 4 and 5.

FIG. 6 illustrates another embodiment according to the present disclosure in which the Velcro tapes 23 are provided on the bottom surface of the cleaning head 10. As illustrated in FIG. 6, the Velcro tapes 23 may be provided at a part of the bottom surface of the cleaning head 10, but otherwise, the Velcro tape 23 may be provided on the entire bottom surface of the cleaning head 10.

An extension block 40 or 40' may be provided at either or both of two opposite sides of the cleaning head 10 so as to be movable in a direction away from the cleaning head 10. In FIG. 1, the extension blocks 40 and 40' are provided at both opposite sides of the cleaning head 10. The extension blocks 40 and 40' can be extended outward from the cleaning head 10 to increase an overall length of the cleaning head 10. With the extension blocks 40 and 40', various sizes of mops can be coupled to the cleaning head 10.

Figure 7:
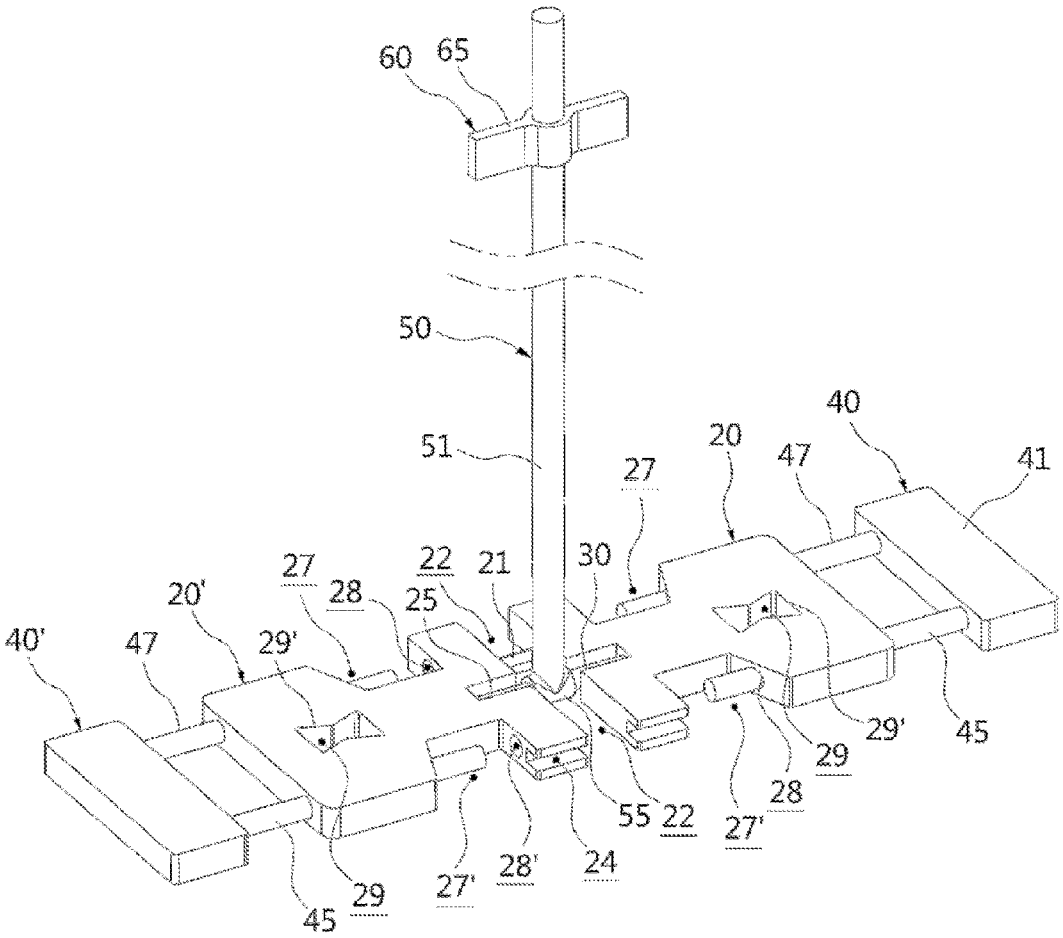
FIG. 7 is a perspective view illustrating a state in which extension blocks included in a mop tool according to yet another embodiment of the present disclosure are extended.

As illustrated in FIG. 7, the extension block 40 includes a block body 41 and extending posts 45 and 47, and the block body 41 is movably provided at one side of the cleaning head 10.

In the present embodiment, the block body 41 of the extension block 40 has a plate shape like the cleaning head 10, and as illustrated in FIG. 7, the block body 41 may be formed to have a thickness and a width which correspond to those of the cleaning head 10.

The extending posts 45 and 47 are provided at one side of the block body 41. The extending post 45 or 47 has a bar shape which extends in a longitudinal direction of the cleaning head 10, and serves to guide the movement of the block body 41 relative to the cleaning head 10. The extending posts 45 and 47 may be the aforementioned mop hanging bars 45 and 47, or components separate from the mop hanging bars 45 and 47. For the sake of convenience, the reference numerals 45 and 47 will indicate the extending posts below.

In the present embodiment, the block body 41 can move close to or away from the cleaning head 10 by the movement of the extending posts 45 and 47 themselves relative to the cleaning head 10. The lengths of the extending posts 45 and 47 may be variable. For example, the extending post 45 or 47 may have a telescopic structure including a plurality of cylindrical components which is stacked on one another, such that a length of the extending post 45 or 47 is adjusted by stretching or folding the plurality of components.

A pair of extending posts 45 and 47 are provided on a single block body 41 so as to be spaced apart from each other, and the extending posts 45 and 47 are installed to traverse the grooves 27 and 27' of the cleaning head 10, such that the connecting loops P1' of the mop P1 can hang from the extending posts 45 and 47 as described above. As illustrated in FIG. 3, the extending posts 45 and 47 are inserted into guide holes 28 and 28' provided in the cleaning head 10. FIG. 7 illustrates a state in which the block bodies 41 are spaced apart from the first head body 20 and the second head body 20' of the cleaning head 10, such that an overall length of the cleaning head 10 is increased.

Figure 8:
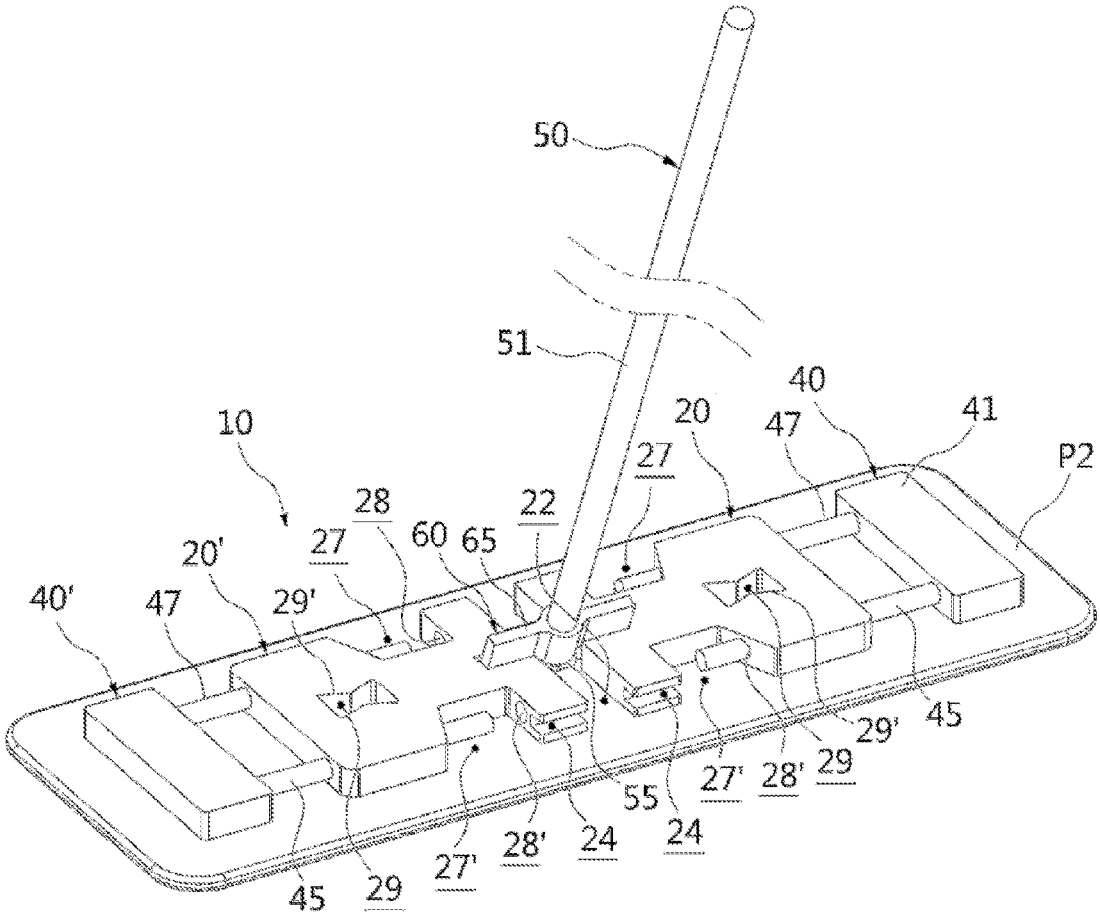
FIG. 8 is a perspective view illustrating a state in which the mop is coupled with the mop tool in a state in which the extension blocks included in the mop tool illustrated in FIG. 7 are extended.

As described above, a user can use the mops having various sizes for the mop tool by using the extension blocks 40. The user can use a mop having a short length after pushing the block bodies 41 so that the block bodies 41 are contact with the cleaning head 10, and can use a mop P2 having a relatively long length after moving the block bodies 41 so that the block bodies 41 are spaced apart from the cleaning head 10 as illustrated in FIG. 8. Since the extension blocks 40 are extended when the long mop P2 is used, pressing force exerted on the mop P2 by the cleaning head 10 can be uniformly distributed over the entire mop P2.

Figure 9:
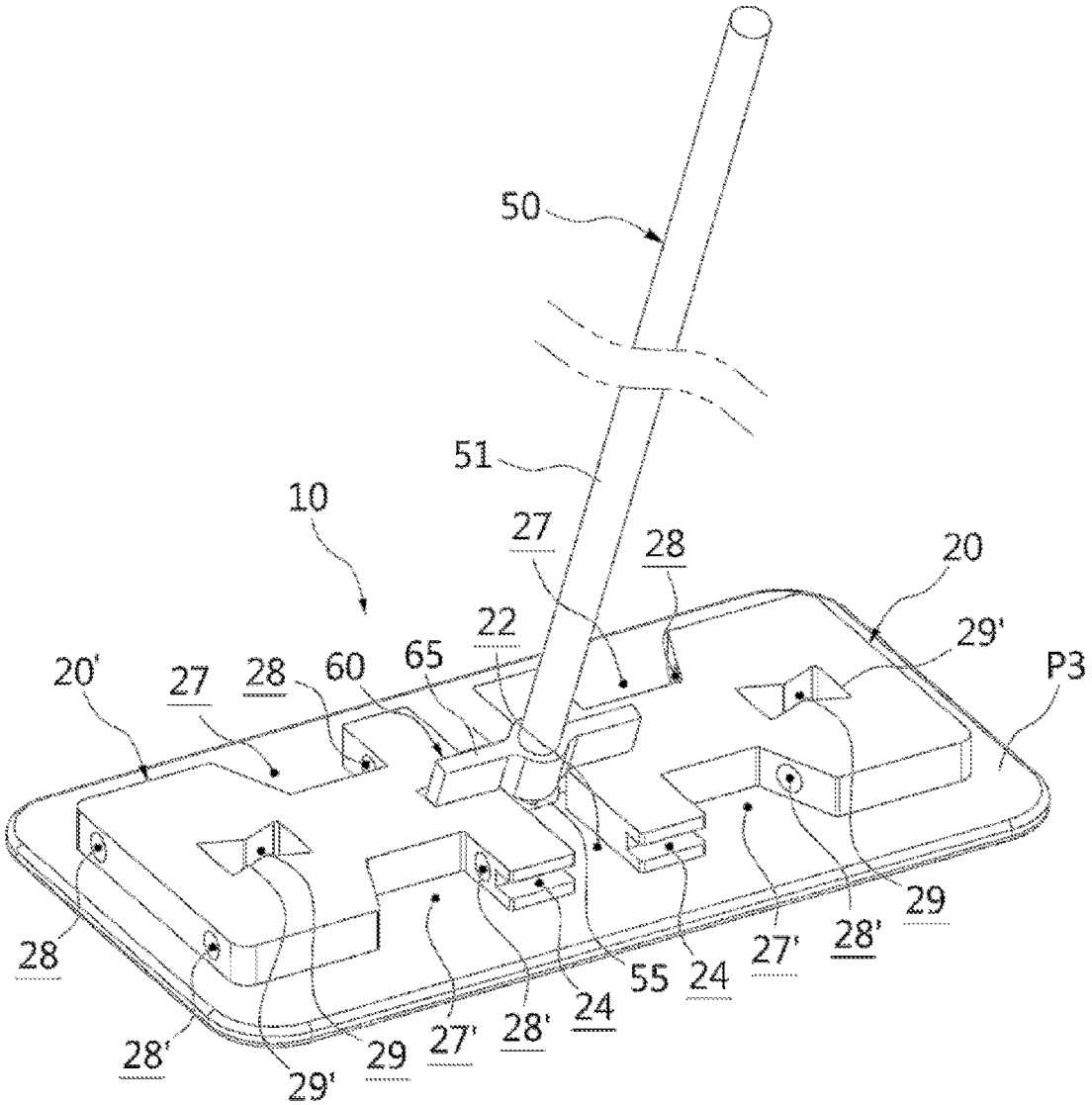
FIG. 9 is a perspective view illustrating a state in which a mop is coupled with a mop tool without extension blocks according to further another embodiment of the present disclosure.

Meanwhile, the extension blocks 40 may be separate from the cleaning head 10, and FIG. 9 illustrates a state in which the extension blocks 40 are separate from the cleaning head 10. Therefore, the user can completely separate the extension blocks 40 from the cleaning head 10, and then use a mop P3 having a short length. Of course, unlike the embodiment of the present disclosure, the cleaning head 10 may be a fixed-length type, which does not have the extension blocks 40 on the cleaning head 10 and is not changed in length.

Figure 10A:
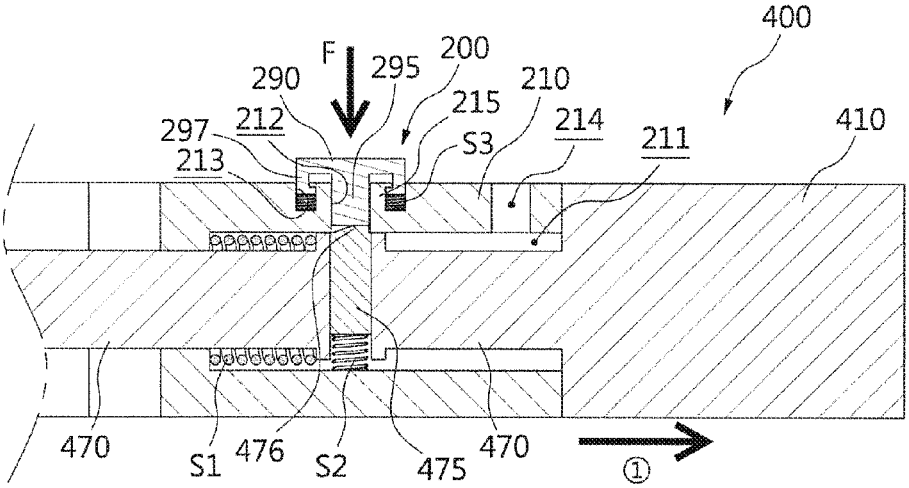
FIGS. 10A and 10B show an operation of the extension blocks included in the mop tool according to another embodiment of the present disclosure.
Figure 10B:
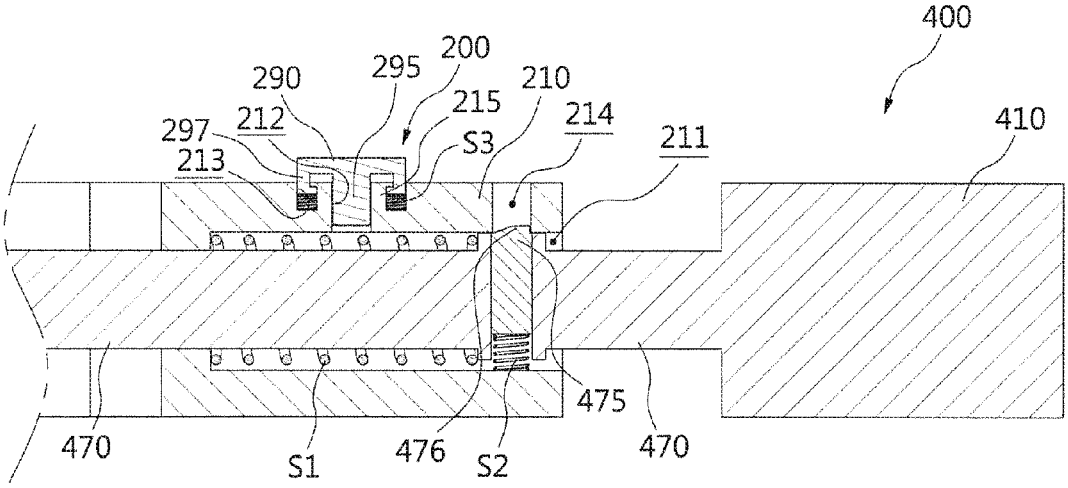

FIGS. 10A and 10B illustrate another embodiment of an extension block 400. As illustrated, the extension block 400 is configured to elastically move away from a cleaning head 200 by means of a first elastic member S1. That is, the extension block 400 is configured to be spaced apart from the cleaning head 200 by elastic force of the first elastic member S1, and one embodiment thereof will be described below.

A movement space 211 is formed in the cleaning head 200, and an extending post 470 is provided to be movable along the interior of the movement space 211. Further, a block body 410 is provided at one end of the extending post 470, and the block body 410 is positioned at one side of the cleaning head 200.

The first elastic member S1 is provided in the movement space 211, and one end of the first elastic member S1 is fixed into the movement space 211 of the cleaning head 200, and the other end of the first elastic member S1 abuts on an operating portion 475 that protrudes from the extending post 470. The first elastic member S1 provides elastic force which pushes the extending post 470 outward.

Fastening structures 212, 214, and 476 are provided at a lateral side of the movement space 211. The fastening structures 212, 214, and 476 serve to fix the extending post 470 at a particular position, and include a fastening protrusion 476 and fastening grooves 212 and 214. The fastening protrusion 476 protrudes from an outer surface of the operating portion 475 of the extending post 470, and the fastening grooves 212 and 214 extend to the outside of the cleaning head 200 from the movement space 211. The fastening grooves 212 and 214 may penetrate the cleaning head 200.

The fastening protrusion 476 is formed to be inclined. In FIGS. 10A and 10B, the fastening protrusion 476 has an inclined surface such that the fastening protrusion 476 is increased in height toward the block body 410. In a case in which the fastening protrusion 476 is inserted into the fastening groove 214, the fastening protrusion 476 can be withdrawn from the fastening groove 214 along the inclined surface of the fastening protrusion 476 when the extending post 470 is moved to the left based on FIG. 10A, but when the extending post 470 is moved to the right based on FIG. 10B, a right surface of the fastening protrusion 476 comes into contact with an edge of the fastening groove, such that the fastening protrusion 476 is prevented from moving to the right. Therefore, it is possible to prevent the extending post 470 from moving to the right by force exerted on the extending post 470 by the first elastic member S1 or by any other external force.

At least two fastening grooves 212 and 214 are provided in the cleaning head 200 along a direction in which the extending post 470 moves. In the present embodiment, two fastening grooves 212 and 214 are provided in the cleaning head 200. The fastening protrusion 476 is selectively caught into the fastening groove 212 or 214, such that a degree to which the block body 410 protrudes from the cleaning head 200 is adjusted. In the aforementioned embodiment, the fastening grooves 212 and 214 are formed in the cleaning head 200, and the fastening protrusion 476 is provided on the extending post 470, but on the contrary, the fastening grooves 212 and 214 may be formed in the extending post 470, and the fastening protrusion 476 may be provided on the cleaning head 200.

Meanwhile, an operation button 290 is provided on an outer surface of the cleaning head 200. The operation button 290 is assembled to be movable into or out of the cleaning head 200, and at least a part of the operation button 290 is inserted into the fastening groove 212. Further, as a part of the operation button 290 which is inserted into the fastening groove 212 pushes the fastening protrusion 476, the fastening protrusion 476 can be released from the fastening groove 212. At this time, the fastening protrusion 476 is in a state of being pressed upward by a second elastic member S2 provided below the fastening protrusion 476.

The operation button 290 includes a pushing portion 295. The pushing portion 295 is inserted into the fastening groove 212 so as to selectively push the fastening protrusion 476, and a catching leg 297 and a stopper 215 corresponding thereto are provided in the operation button 290 and the cleaning head 200, respectively. Further, a third elastic member S3 is provided in a leg groove 213 formed in the cleaning head 200, and allows the operation button 290 and the pushing portion 295 to move away from the outer surface of the cleaning head 200 when external force is removed by pushing the catching leg 297. Of course, since the fastening protrusion 476 and the pushing portion 295 abutting thereon may be pressed together by the second elastic member S2, the third elastic member S3 may be omitted.

The fastening protrusion 476 may be configured as a separate component to be assembled to the extending post 470 so that the fastening protrusion 476 can move in a direction orthogonal to the movement direction of the extending post 470, that is, a vertical direction on FIG. 10A, and the fastening protrusion 476 can be pushed downward by the operation button 290, or be moved upward by the second elastic member S2.

In a process of operating the operation button 290, when the user moves the operation button 290 downward by pushing the operation button 290 with a hand or a foot while overcoming elastic forces of the second elastic member S2 and the third elastic member S3, the pushing portion 295 of the operation button 290 presses the fastening protrusion 476 downward.

During this process, the fastening protrusion 476 is released from the fastening groove 212 while moving downward, and at the same time, the first elastic member S1 presses the operating portion 475 of the extending post 470, and moves the extending post 470. Therefore, the extending post 470 and the block body 410 provided thereon move together, and the fastening protrusion 476 is inserted and caught into the fastening groove 214 during the movement process. Since the second elastic member S2 always presses the fastening protrusion 476, the second fastening protrusion 476 is inserted into the fastening groove 214. The state described above is illustrated in FIG. 10B.

Therefore, an overall length of the cleaning head 200 is increased as the block body 410 is spaced apart from the cleaning head 200, and as a result, the user can couple the mop having a relatively long length to the cleaning head 200.

On the contrary, in a case in which the user intends to decrease a length of the cleaning head 200, the user moves the block body 410 and the extending post 470 by pressing the block body 410 in a direction toward the outer surface of the cleaning head 200 while overcoming elastic force of the first elastic member S1, thereby allowing the fastening protrusion 476 to be caught again into the fastening groove 212 disposed relatively inward.

Next, a locker 60 will be described. The locker 60 serves to restrict a relative rotation between the cleaning head 10 and the stick 50, and is provided to be movable along the stick 50 as illustrated in FIGS. 1 and 2.

A first locking groove 24 is formed at a lateral side of the cleaning head 10 which is positioned on a rotation route of the stick 50. Referring to FIG. 7, the first locking groove 24 is dented from a lateral surface of the cleaning head 10. The first locking groove 24 may be opened to form a predetermined angle, for example, a right angle with respect to a second locking groove 25 to be described below.

As illustrated in FIGS. 3 and 6, when the locker 60 is inserted into the first locking groove 24, the stick 50 can be fixed in a state of extending in parallel with the cleaning head 10. In this state, the user can conveniently put the mop P1 into a bucket and wash the mop P1 and also can clean a high place of a window or a wall by lifting up the cleaning head 10.

Meanwhile, the locker 60 can be moved toward a central portion of the cleaning head 10 and then inserted and fixed into the second locking groove 25, thereby preventing the stick 50 and the cleaning head 10 from rotating relative to each other. In FIG. 9, the locker 60 is inserted into the second locking groove 25, such that the stick 50 forms a predetermined angle with respect to the cleaning head 10.

With the locker 60, the user can fix the cleaning head 10 and the stick 50 so as to prevent a relative rotation between the cleaning head 10 and the stick 50 or can adjust a coupling angle between the cleaning head 10 and the stick 50. As illustrated in FIG. 6, the locker 60 is moved upward along the stick 50 (in a direction of the arrow ⓐ) to allow the stick 50 to be released from a locked state in which the locker 60 is inserted into the first locking groove 24 and to be rotated relative to the cleaning head 10 (in a direction of the arrow ⓑ).

As illustrated in FIGS. 2 and 7 to 9, the user can withdraw the locker 60 from the first locking groove 24 or the second locking groove 25, and then use the mop tool in a state in which the stick 50 and the cleaning head 10 can freely rotate relative to each other.

The locker 60 may include a locking body which has a coupling hole through which the stick 50 is inserted, and locking pieces 65 which protrude from two opposite sides of the locking body. The locking pieces 65 are portions which are inserted into the first locking groove 24 or the second locking groove 25.

Figure 11:
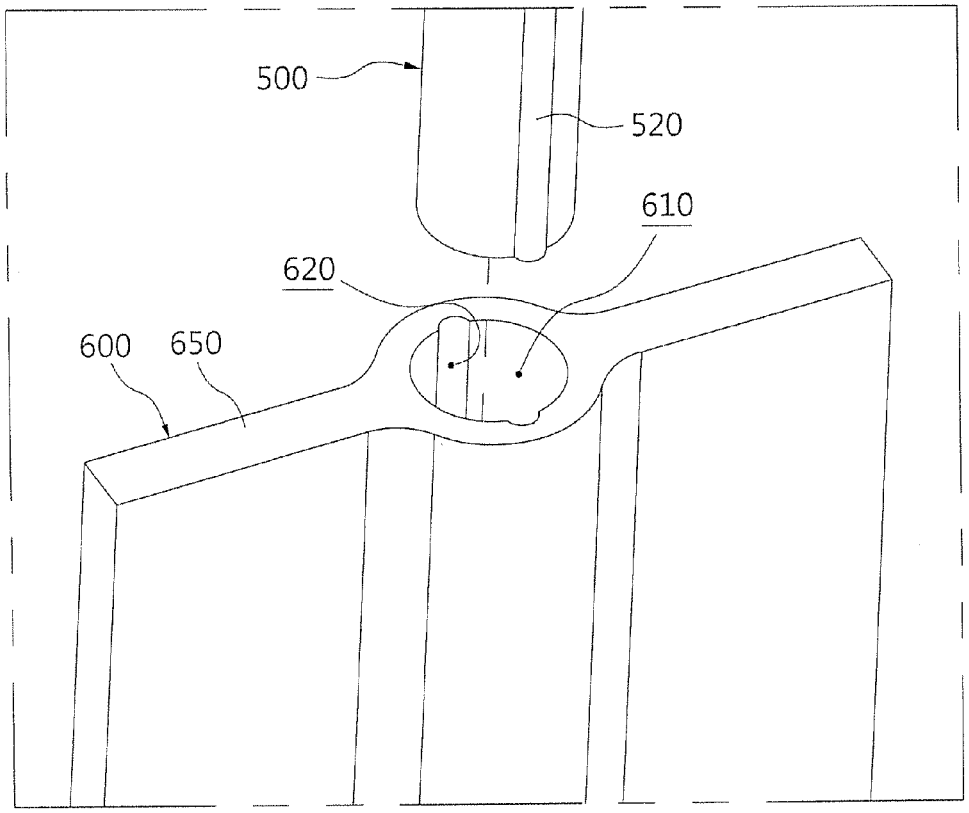
FIG. 11 is a perspective view illustrating an embodiment of a locker included in a mop tool according to an embodiment of the present disclosure.

FIG. 11 illustrates another embodiment of a locker 600. As illustrated in FIG. 11, the locker 600 may have an elongated shape of extending in a longitudinal direction of a stick 500. Therefore, the user can manipulate the locker 600 at a position far away from the cleaning head 10, thereby preventing a hand or a foot from coming into direct contact with a dirty mop during a process of manipulating the locker 600. Reference numeral 650 indicates locking pieces.

Guide ribs 520 and guide grooves 620, which correspond to each other, may be formed in an inner surface of a coupling hole 610 formed in the locker 600, and on an outer surface of the stick 500, thereby allowing the locker 600 to move along the stick 500 in a predetermined direction. Of course, the guide rib 520 may be provided on the locker 600, and the guide groove 620 may be provided in the stick 500.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A mop tool comprising:

an elongated stick; and a plate-shaped cleaning head rotatably coupled to one end of the stick and having two or more mop fasteners that have different coupling types, wherein the cleaning head is provided with a mop hanging bar from which a connecting loop of a mop hangs.

2. The mop tool of claim 1, wherein at least one of the mop fasteners includes a mop fixing hole or a hook-and-loop tape, and wherein a part of the mop can be fitted into the mop fixing hole or the mop can be coupled to the hook-and-loop tape.

3. The mop tool of claim 2, wherein the mop fixing hole is provided with a fixing protrusion protruding in a direction of narrowing an inlet of the mop fixing hole.

4. The mop tool of claim 1, wherein the cleaning head has at least one groove inwardly dented therein and the mop hanging bar traverses the groove.

5. The mop tool of claim 1, wherein the cleaning head has a gap extending from a portion where the cleaning head is coupled to the one end of the stick to at least one side of the cleaning head, and the stick rotates to pass through the gap.

6. The mop tool of claim 1, further comprising:

at least one extension block provided at either or both of two opposite sides of the cleaning head so as to be movable away from the cleaning head.

7. The mop tool of claim 6, wherein the extension block includes:

a block body; and at least one extending post having one end coupled to the block body and another end extending into the cleaning head.

8. The mop tool of claim 7, wherein the extending post and the cleaning head have fastening structures corresponding to each other in order to allow an adjustment of a protrusion amount of the extension block from the cleaning head.

9. The mop tool of claim 8, wherein the fastening structures include:

a fastening protrusion provided on the extending post; and fastening grooves in the cleaning head, the fastening protrusion being selectively inserted into the fastening grooves, wherein the fastening grooves are formed to be spaced apart from each other in a direction in which the extending post moves.

10. The mop tool of claim 1, further comprising:

a locker movable along the stick and selectively coupled to a side of the cleaning head in order to restrict a relative rotation between the cleaning head and the stick.

11. The mop tool of claim 10, wherein a first locking groove is formed at a lateral side of the cleaning head which is positioned on a rotation route of the stick, and the locker can be inserted to the first locking groove.

12. The mop tool of claim 11, wherein the cleaning head has a gap extending from a portion where the cleaning head is coupled to the one end of the stick toward the lateral side of the cleaning head at which the first locking groove is formed, and the stick rotates to pass through the gap.

13. The mop tool of claim 12, wherein a second locking groove is formed at a central portion of the cleaning head and the locker can be inserted to the second locking groove, and wherein when the locker is inserted into the second locking groove, the stick forms a predetermined angle with respect to the cleaning head.

14. The mop tool of claim 13, wherein the locker includes:

a locking body having a coupling hole into which the stick is inserted; and locking pieces extending from two opposite sides of the locking body to be inserted into the first locking groove or the second locking groove.

15. The mop tool of claim 1, wherein the one end of the stick is hingedly coupled to a central portion of the cleaning head.

* * * * *